US007657207B2

(12) United States Patent
Kang

(10) Patent No.: US 7,657,207 B2
(45) Date of Patent: Feb. 2, 2010

(54) BELT DRIVING DEVICE, TRANSFER UNIT USING THE SAME AND IMAGE FORMING APPARATUS USING THE TRANSFER UNIT

(75) Inventor: Il-kwon Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 203 days.

(21) Appl. No.: 11/832,341

(22) Filed: Aug. 1, 2007

(65) Prior Publication Data

US 2008/0124120 A1 May 29, 2008

(30) Foreign Application Priority Data

Nov. 24, 2006 (KR) ..... 10-2006-0117052

(51) Int. Cl.

| | |
|---|---|
| ***G03G 15/08*** | (2006.01) |
| ***G03G 15/00*** | (2006.01) |
| ***G03G 15/01*** | (2006.01) |
| ***G03G 15/20*** | (2006.01) |

(52) U.S. Cl. ..... 399/121; 399/162; 399/164; 399/165; 399/302; 399/303; 399/308; 399/312; 399/313

(58) Field of Classification Search ..... 399/121, 399/165, 162, 303, 312, 164, 313, 308, 302
See application file for complete search history.

(56) References Cited

U.S. PATENT DOCUMENTS

| | | | |
|---|---|---|---|
| 5,991,575 | A | 11/1999 | Okiyama et al. |
| 6,269,231 | B1 | 7/2001 | Castelli et al. |
| 2002/0094213 | A1 | 7/2002 | Yamamoto et al. |

FOREIGN PATENT DOCUMENTS

| | | |
|---|---|---|
| JP | 2001-022188 | 1/2001 |
| JP | 2003-173090 | 6/2003 |
| KR | 2005-4507 | 1/2005 |

OTHER PUBLICATIONS

European Search Report mailed on Mar. 4, 2008.

*Primary Examiner*—David M Gray
*Assistant Examiner*—Rodney Bonnette
(74) *Attorney, Agent, or Firm*—Stein McEwen, LLP

(57) ABSTRACT

An image forming apparatus includes a developing unit which develops toner to form an image, a transfer unit which transfers the image onto a printing medium, and a fusing unit to fuse the image transferred onto the printing medium, wherein the transfer unit includes a belt, a plurality of rollers which rotatably supports the belt, and a belt tension applying unit which moves a first roller of the plurality of rollers between a belt tension release position at which a tension of the belt releases and a belt tension applying position at which the tension of the belt applies by the interlocking motion between the belt tension applying unit and a second roller of the plurality of rollers.

23 Claims, 9 Drawing Sheets

BELT DRIVING DEVICE, TRANSFER UNIT USING THE SAME AND IMAGE FORMING APPARATUS USING THE TRANSFER UNIT

CROSS-REFERENCE TO RELATED APPLICATION

This application claims the benefit of Korean Application No. 2006-117052, filed on Nov. 24, 2006, in the Korean Intellectual Property Office, the disclosure of which is incorporated herein by reference.

BACKGROUND OF THE INVENTION

1. Field of the Invention

Aspects of the present invention relate to a belt driving device, a transfer unit using the same and an image forming apparatus using the transfer unit, and more particularly, to a belt driving device having a structure capable of automatically applying tension to a belt in a loosened state when the belt begins to move, a transfer unit using the belt driving device and an image forming apparatus using the transfer unit.

2. Description of the Related Art

Generally, a belt driving device drives at least one of a plurality of rollers which are disposed at an inner circumference of a belt, thus driving the belt to rotate by friction generated between the belt and the at least one roller. The belt driving device is extensively used in various types of electrophotographic image forming apparatuses, such as a laser printer, a laser facsimile, a digital copying machine and other known image forming apparatuses in the art. These image forming apparatuses include various types of belts, such as a photosensitive belt, a transfer belt which transfers a toner image onto a photosensitive medium, a conveying belt which conveys a printing medium, and other known belts in the art.

FIG. 1 is a schematic front view of a conventional belt driving device. As shown in FIG. 1, the conventional belt driving device is embodied as a device which drives a transfer belt used in the image forming apparatus. The conventional belt driving device includes a plurality of rollers rotatably supporting a belt 10 which performs image transferring to and conveying of a printing medium (not shown), a frame (not shown) which supports the rollers, and an elastic member 25 which applies tension to the belt 10. The rollers include a driving roller 21 which drives the belt 10 to rotate, a tension roller 23 which is elastically biased by the elastic member 25 so that the belt 10 maintains a predetermined tension, and an auxiliary roller 27 which supports the belt 10 to prevent the belt 10 from interfering with other elements.

In this conventional belt driving device, image transferring is performed at a surface of the belt 10, in a location between the driving roller 21 and the tension roller 23. To this end, each of a plurality of transfer rollers 30 is disposed at a position where a color image is transferred to the printing medium.

According to the belt driving device having the above structure, if the predetermined tension is continuously applied to the belt 10 for a long time in a state where the belt 10 is not driven, for example, when the belt driving device is manufactured and then inserted into a product, such as image forming apparatus, which is distributed or kept in a warehouse, the following problem may occur. Parts of the belt 10 which are in contact with the rollers, such as the driving roller 21 and the tension roller 23, are kept in a state where the parts are bent to have a shape of a circular arc according to the shape of the rollers. Accordingly, concentrated deformation of the belt 10 occurs at these parts. As a result, this belt deformation has an adverse effect on printing quality when an image is transferred to the printing medium.

Therefore, to avoid this problem, the tension applied to the belt 10 should be removed during a period of non-use, specifically until a user starts to use an apparatus including the belt driving device. To this end, a conventional belt driving device has been introduced as shown in FIG. 2. This belt driving device additionally includes a release spacer 50 capable of releasing the tension applied to the belt 10 during the period of non-use.

The release spacer 50 is capable of removing the belt tension during the period of non-use of the product, for example, while the product is kept in a warehouse, until the product is used for the first time. To this end, the release spacer 50 is inserted between a bushing 24 which supports the tension roller 23 and the frame 1. In this configuration, the elastic member 25 maintains a state of being pressed by the release spacer 50, so that the elastic pressure of the elastic member 25 is not transferred to the tension roller 23. Accordingly, the release spacer 50 prevents the tension from being applied to the belt 10 during a period of non-use.

According to the above structure, when the image forming apparatus is to be used for the first time, the user should remove the release spacer 50 from the belt driving device in direction A shown in FIG. 2 by hand, so that the elastic pressure of the elastic member 25 can be transferred to the tension roller 23, thus enabling the tension to be applied to the belt 10. However, a user who does not have knowledge about products using the belt 10 and the release spacer 50, such as an image forming apparatus or other known apparatuses in the art, may forget to remove the release spacer 50. Even if an installing method is described in detail in a user manual or other set of instructions, the user may install the belt 10 or product using the belt 10 without reading the manual or instructions carefully. Accordingly, the product may be used in a state where the release spacer 50 is not removed.

In this case, since the belt 10 is driven in a state where the tension is not applied to the belt 10, the belt 10 is not driven normally, thus preventing printing and other operations from being performed normally. Also, internal components of the belt driving device may be damaged, thus causing damage to the entire product.

SUMMARY OF THE INVENTION

Accordingly, it is an aspect of the present invention to provide a belt driving device, a transfer unit using the same and an image forming apparatus using the transfer unit which has a structure capable of not only maintaining a belt in a loosened state by removing tension applied to the belt until the belt is used for the first time, but also capable of automatically applying the tension to the belt when the belt is driven without a user performing a manual operation.

The foregoing and/or other aspects of the present invention can be achieved by an image forming apparatus, including a developing unit which develops toner to form an image, a transfer unit which transfers the image onto a printing medium, and a fusing unit to fuse the image transferred onto the printing medium, wherein the transfer unit includes a belt, a plurality of rollers which rotatably support the belt, and a belt tension applying unit which moves a first roller of the plurality of rollers between a belt tension release position at which a tension of the belt releases and a belt tension applying position at which the tension of the belt applies by the interlocking motion between the belt tension applying unit and a second roller of the plurality of rollers.

According to an aspect of the invention, the belt tension applying unit includes a locking release protrusion which protrudes from the second roller, a locking link which moves by contacting the locking release protrusion as the second roller rotates, and a supporting member which rotatably supports the first roller to be movable in a direction to put the first roller in the belt tension applying position.

According to an aspect of the invention, the locking link has a first blocking projection, and the supporting member has a second blocking projection blocked by the first blocking projection until the locking link is moved by contacting the locking release protrusion.

According to an aspect of the invention, the belt tension applying unit further includes a locking release spring which elastically biases the supporting member in the direction to put the first roller in the belt tension applying position and restores the first roller supported by the supporting member to the belt tension applying position if the second blocking projection is released from being blocked by the first blocking projection.

According to an aspect of the invention, the first roller is a backup roller which rotatably supports the belt, the second roller is a driving roller which drives the belt to rotate, the third roller is a tension roller which is elastically biased by the elastic member and applies the predetermined tension to the belt, the locking release protrusion is formed on the driving roller, and the supporting member rotatably supports the backup roller.

According to another aspect of the present invention, an image forming apparatus includes a developing unit which develops toner to form an image, a transfer unit which transfers the image onto a printing medium, and a fusing unit to fuse the image transferred onto the printing medium, wherein the transfer unit includes a belt, a plurality of rollers including a driving roller which rotatably drives the belt and a tension roller which applies a tension to the belt, and a belt tension applying unit which releases the belt from the tension by positioning the tension roller at a belt tension release position until the belt is driven for an initial time, and which moves in an interlocking motion with a rotation of the driving roller if the belt is driven for the first time to restore the tension roller to a belt tension applying position where the tension is applied to the belt.

According to another aspect of the invention, the image forming apparatus includes a locking release protrusion which protrudes from a side part of the driving roller, a locking link which has a first blocking projection and moves by contacting the locking release protrusion if the driving roller rotates, a supporting member which rotatably supports the tension roller, is movable in a direction to put the tension roller in the belt tension applying position, and includes a second blocking projection blocked by the first blocking projection until the locking link is moved by contacting the locking release protrusion, and an elastic member which elastically biases the supporting member in the direction to put the second roller in the belt tension applying position and restores the tension roller to the belt tension applying position to apply the tension to the belt if the second blocking projection is released from being blocked by the first blocking projection.

According to another aspect of the present invention, a transfer unit includes a transfer belt to transfer a printing medium, a plurality of rollers which rotatably supports the transfer belt and includes at least one transfer roller which is disposed at a position where a toner image of a predetermined color is transferred to the printing medium, and a belt tension applying unit which moves a first roller of the plurality of rollers between a belt tension release position at which a tension of the belt releases and a belt tension applying position at which the tension of the belt applies by the interlocking motion between the belt tension applying unit and a second roller of the plurality of rollers.

According to another aspect of the present invention, the belt tension applying unit includes a locking release protrusion which protrudes from the second roller, a locking link which has a first blocking projection and moves by contacting the locking release protrusion if the second roller having the locking release protrusion rotates, a supporting member which rotatably supports the first roller, is movable in a direction to put the first roller in the belt tension applying position, and includes a second blocking projection blocked by the first blocking projection until the locking link is moved by contacting the locking release protrusion, and a locking release spring which elastically biases the supporting member in the direction to put the first roller in the belt tension applying position and restores the first roller supported by the supporting member to the belt tension applying position if the second blocking projection is released from being blocked by the first blocking projection.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
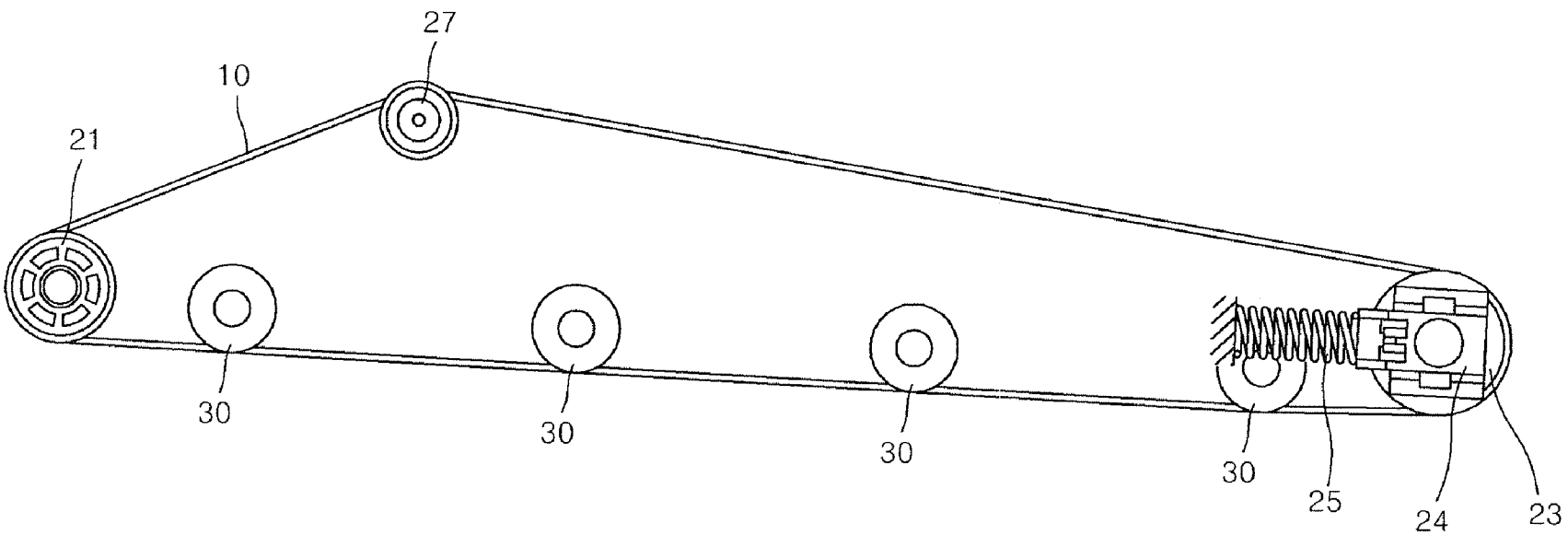
FIG. 1 (RELATED ART)
FIG. 1 is a schematic front view of a conventional belt driving device.
Figure 2:
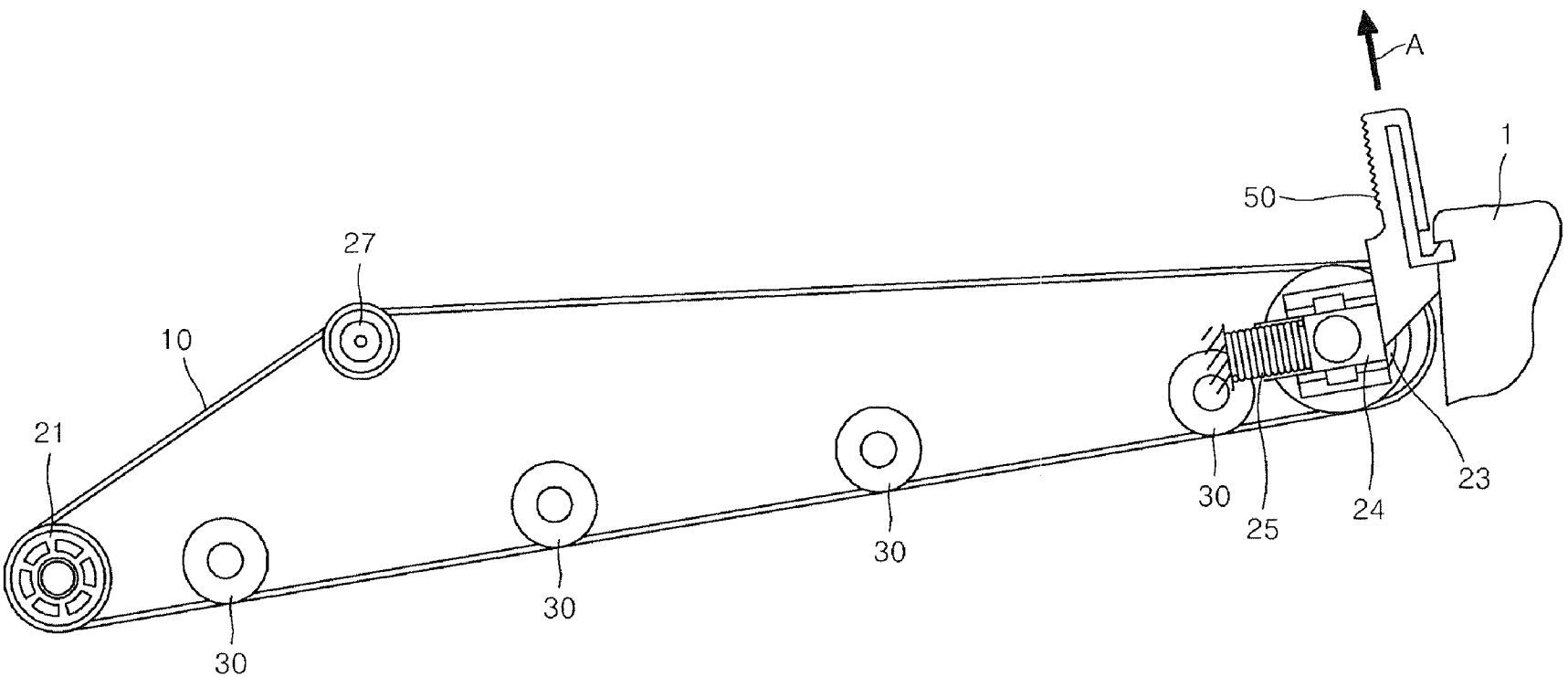
FIG. 2 (RELATED ART)
FIG. 2 is a schematic front view of a conventional belt driving device which uses a release spacer.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Hereinafter, a belt driving device according to aspects of the present invention is explained using embodiments thereof which are used in a transfer unit disposed in a so-called tandem type color image forming apparatus. However, the belt driving device according to aspects of the present invention is not limited to being embodied in the transfer unit disposed in a tandem type color image forming apparatus, but is also applicable to other image forming apparatuses, such as a monochrome printer, a facsimile, a digital copying machine and other known image forming apparatuses in the art. Also, the belt driving device according to aspects of the present invention is applicable to a printing medium conveying unit which conveys a printing medium, a photosensitive belt unit which forms a latent image to carry a toner image, an intermediate transfer unit which maintains a transferred toner image, and other known units in the art. Furthermore, the belt driving device according to aspects of the present invention is not limited to being used in apparatuses related to printing, and is applicable to belt conveying devices of belt conveyors and other types of conveyors known in the art.

Figure 3:
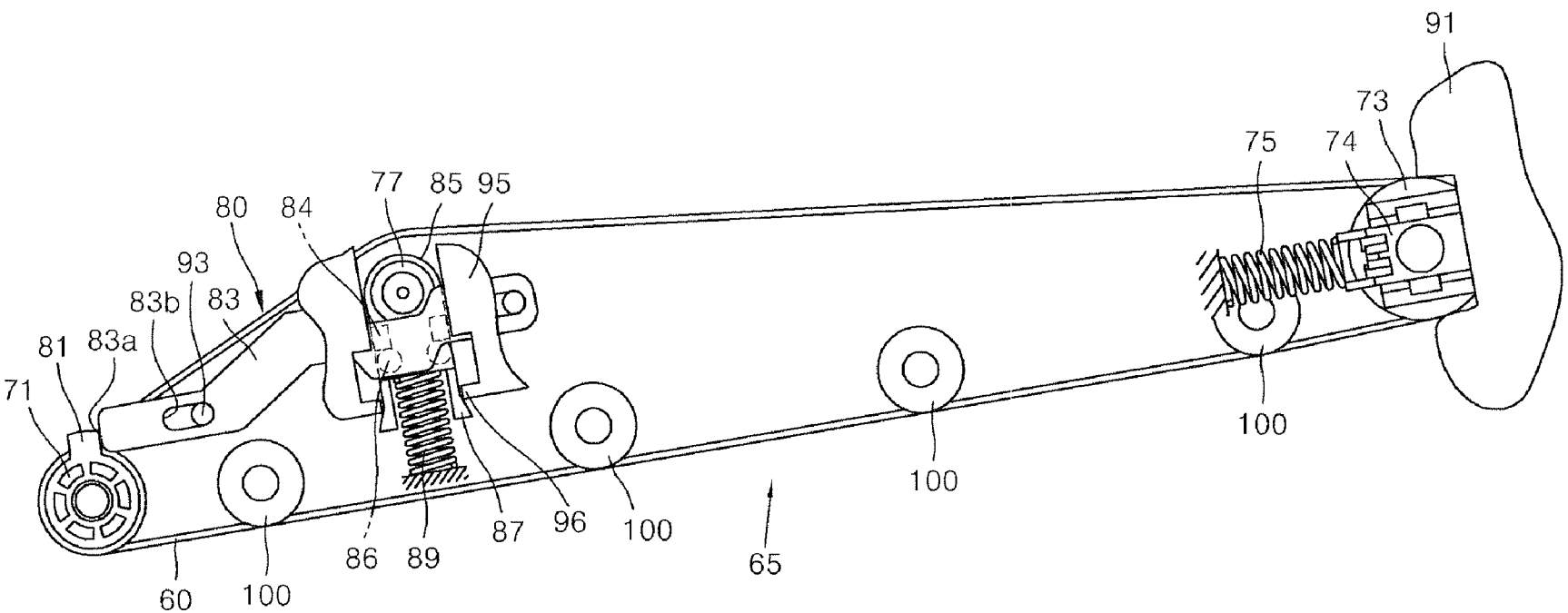
FIG. 3 is a schematic front view of a transfer unit which uses a belt driving device according to an embodiment of the present invention.
Figure 4:
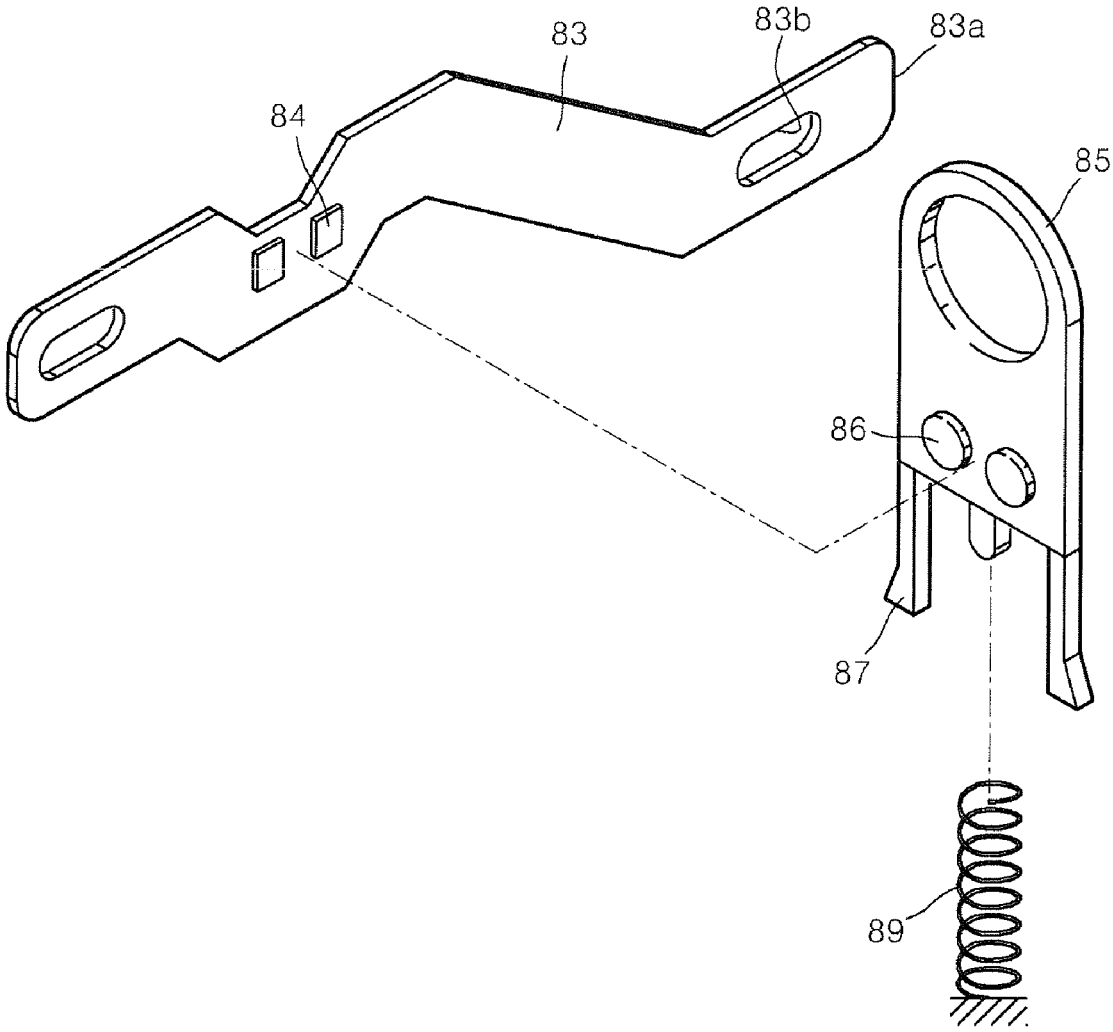
FIG. 4 is an exploded perspective view of a locking link and a supporting member of the transfer unit illustrated in FIG. 3.
Figure 5:
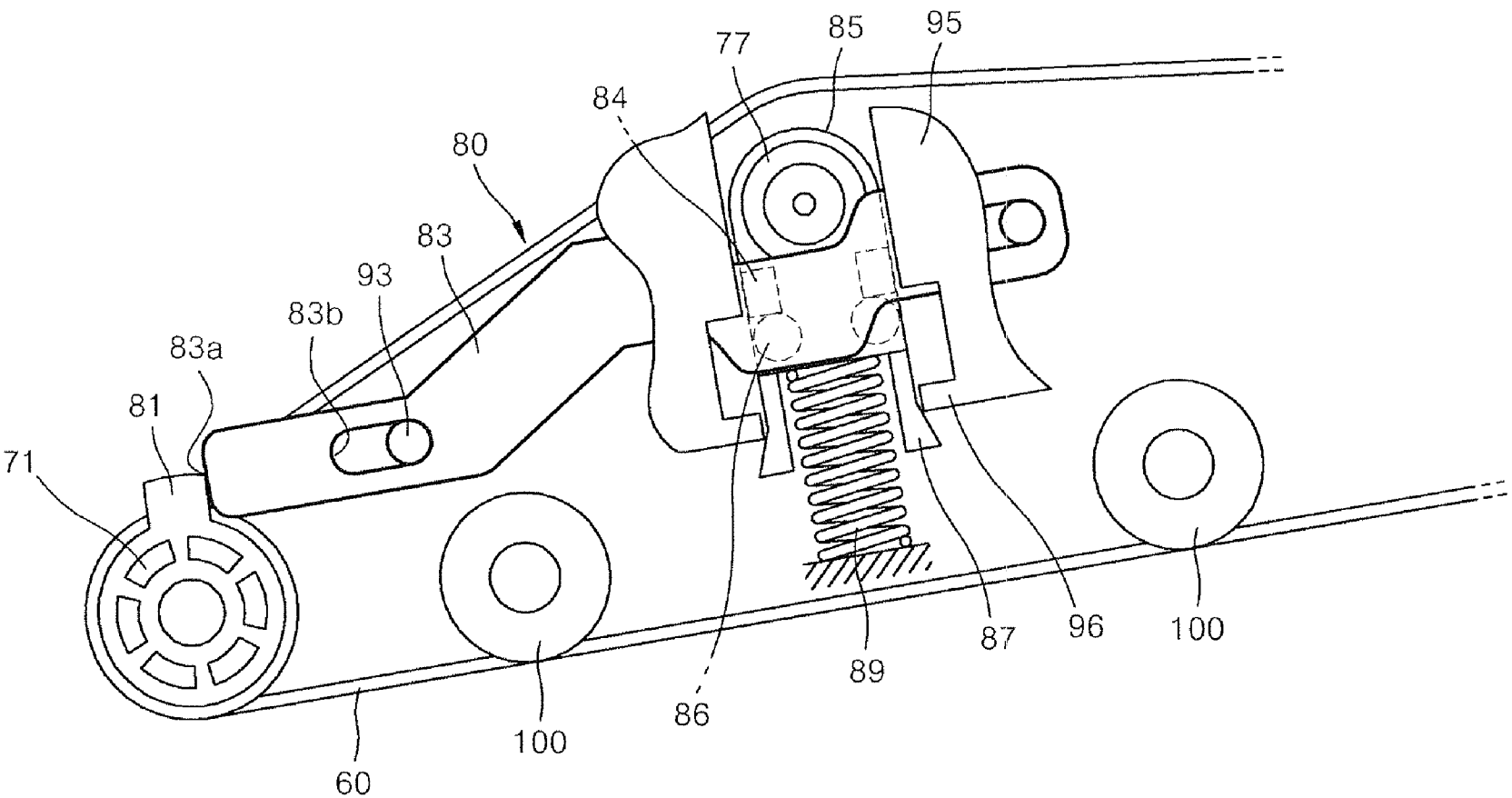
FIG. 5 and FIG. 6 are schematic front views of the transfer unit illustrated in FIG. 3 in positions according to an operation state of the belt driving device.
Figure 6:
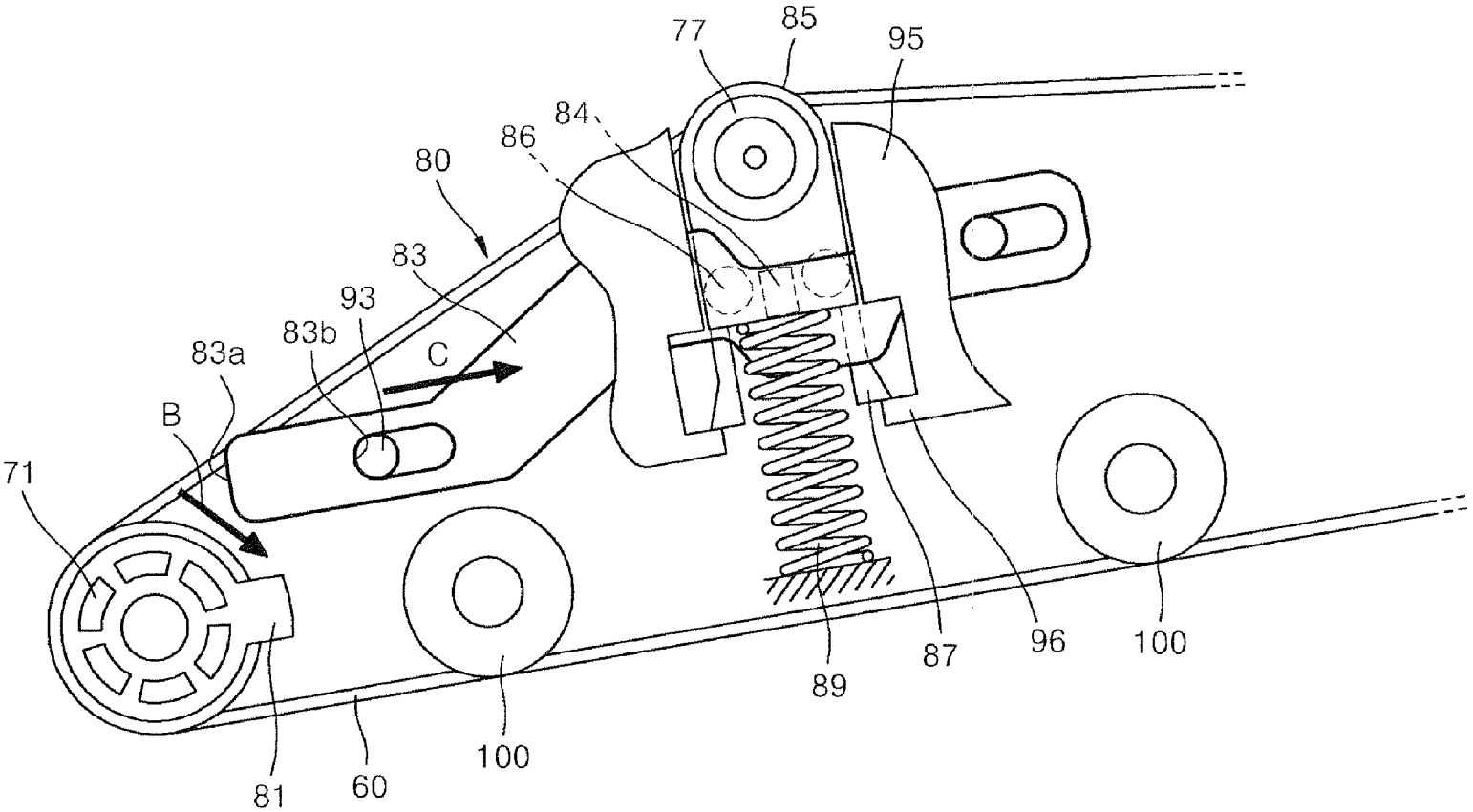

FIG. 3 is a schematic front view of a transfer unit 65 which uses a belt driving device according to an embodiment of the present invention. FIG. 4 is an exploded perspective view of a locking link and a supporting member of the transfer unit illustrated in FIG. 3. FIG. 5 and FIG. 6 are schematic front views illustrating the belt transfer unit of FIG. 3 in positions according to an operation state of the belt driving device.

As shown in FIG. 3, FIG. 4, FIG. 5 and FIG. 6, the transfer unit 65, which uses the belt driving device according to an embodiment of the present invention, includes a belt 60, a belt driving device which is disposed in a main frame (not shown) to drive the belt 60 to rotate, and at least one transfer roller 100 which is disposed at a position where the toner image of a predetermined color is transferred to a printing medium (not shown) conveyed by the belt 60.

The belt driving device includes a plurality of rollers which rotatably support the belt 60, and an elastic member 75 and a belt tension applying unit 80 which are configured to apply tension to the belt 60. The plurality of rollers includes a driving roller 71 which drives the belt 60 to rotate, a tension roller 73 which is elastically biased towards a frame part 91 by the elastic member 75 to apply the tension to the belt 60, and a backup roller 77 which rotatably supports the belt 60 and prevents the belt 60 from interfering with other elements.

The driving roller 71 is coupled to a driving source (not shown) either directly, such as directly coupled to a motor, or indirectly via a driving force transfer mechanism, such as a gear and other known driving components in the art. Also, at least one photosensitive medium (not shown) is disposed to face a surface of the belt 60, at a position between the driving roller 71 and the tension roller 73. Also, the at least one transfer roller 100 is disposed at an inner surface of the belt 60 at a position opposing a corresponding photosensitive medium. Accordingly, the toner image which is formed on the photosensitive medium is transferred to a printing medium (not shown) such as a sheet of paper, a transparency sheet, etc., at the position where the at least one transfer roller 100 is disposed.

The belt tension applying unit 80 releases the belt 60 by putting the backup roller 77 at a predetermined position to remove the tension applied to the belt 60 until the belt 60 is initially driven for the first time. Then, when the belt 60 is initially driven for the first time after the installation of the transfer unit 65 in an image forming apparatus, the belt tension applying unit 80 moves in an interlocking motion with a rotation of the driving roller 71 and restores the backup roller 77 to a predetermined position where the tension is applied. Accordingly, when the belt 60 is driven for the first time, the tension is automatically applied to the belt 60 without a user performing a separate manual operation.

To this end, the belt tension applying unit 80 includes a locking release protrusion 81 which protrudes from the driving roller 71, a locking link 83 which moves by contacting the locking release protrusion 81 at an end part 83*a*, a supporting member 85 which rotatably supports the backup roller 77 and is disposed to be movable in a predetermined direction towards the belt 60, and a locking release spring 89. The locking release protrusion 81 is formed at a side part of the driving roller 71 and does not affect the movement of the belt 60 when the driving roller 71 is driven to rotate.

The locking link 83 is slidable along the main frame (not shown) and moves in connection with the locking release protrusion 81. To this end, an elongated guide hole 83*b* is formed in the locking link 83, and a guide protrusion 93 is formed on the main frame to be coupled to the elongated guide hole 83*b*. It is understood that the elongated guide hole 83*b* may instead be formed on the main frame, and the guide protrusion 93 may be formed on the locking link 83.

Also, when the belt driving device is in a period of non-use, such as during manufacturing or when a product including the belt driving device, such as an image forming apparatus, is distributed, the locking link 83 is disposed to be inclined toward the driving roller 71 as shown in FIG. 3 and FIG. 5. According to this configuration, the locking link 83 only slightly contacts the locking release protrusion 81 or is disposed apart from the locking release protrusion 81, so that the locking link 83 is not prematurely moved by the locking release protrusion 81.

On the other hand, when the belt driving device is in use, the belt tension applying unit 80 is disposed as shown in FIG. 6, where the locking release spring 89 elastically presses the supporting member 85 to move the backup roller 77 toward an outside of the belt 60, so that the tension is applied to the belt 60. To this end, the supporting member 85 rotatably supports the backup roller 77 and is disposed to be movable in a direction in which the backup roller 77 moves to apply the tension to the belt 60. To regulate the movement of the supporting member 85, first and second blocking projections 84 and 86 are formed at a side of the locking link 83 and a side of the supporting member 85, respectively, where the side of the locking link 83 and the side of the supporting member 85 face each other.

Accordingly, as shown in FIG. 5, when the belt driving device is in a period of non-use, such as during manufacturing or when the product including the belt driving device, such as an image forming apparatus is distributed, the second blocking projection 86 is blocked by the first blocking projection 84, preventing an elastic force stored by the locking release spring 89 from being transmitted to the supporting member 85. Therefore, the tension applied to the belt 60 is lessened, and the belt 60 maintains a loosened state.

As described above, the tension applied to the belt 60 should be removed during a period of non-use. Thus, the tension roller 73 can be prevented from applying tension to the belt 60 due to an elastic bias of the elastic member 75 in a manner as follows. A frame part 91 of the main frame is disposed to be opposite to a bushing 74 which rotatably supports the tension roller 73. Accordingly, the frame part 91 can be used to restrict an operating distance which the tension roller 73 can be elastically moved by the elastic member 75 to less than a distance which the backup roller 77 can be elastically moved by the locking release spring 89. Thus, a distance between a retracted position of the backup roller 77 as illustrated in FIGS. 3 and 5 and an extended position of the backup roller 77 as illustrated in FIG. 6 is greater than the operating distance of the tension roller 73. As a result, the tension applied to the belt 60 is removed.

When the transfer unit 65 according to aspects of the present invention is used in the image forming apparatus and the belt 60 is driven for the first time, for example, by transmitting electric power to the driving roller 71 to drive the driving roller 71 to rotate, a locking state ends. Accordingly, as shown in FIG. 6, the locking link 83 slides the first blocking projection 84 past the second blocking projection 86 so that the second blocking projection 86 is not blocked by the first blocking projection 84. The elastic force of the locking release spring 89 is then transmitted to the supporting member 85, so that the tension can be applied to the belt 60.

As shown in FIG. 6, the locking release protrusion 81, which rotates along with the driving roller 71, rotates in direction B and pushes the end part 83*a* of the locking link 83. Accordingly, the locking link 83 moves in direction C. In this case, a guide frame 95 connected to the main frame prevents the supporting member 85 from moving in the direction C, and thereby restricts the supporting member 85 to moving only in a direction perpendicular to the direction C.

Therefore, as the locking link 83 moves, the first blocking projection 84, which restricts a vertical movement of the second blocking projection 86, moves to the side of the second blocking projection 86. As a result, the supporting member 85, along with the backup roller 77 which is rotatably supported in the supporting member 85, jointly move towards the outside of the belt 60 by the elastic force of the locking release spring 89, and move to a position of a normal operating state of the backup roller 77.

To lock the supporting member 85 into the normal operating state of the backup roller 77 after the belt 60 has been driven by the belt driving device for the first time as described above, the belt tension applying unit 80 further includes at least one stopping projection 96 which is formed at the guide frame 95 and at least one stopper 87 corresponding to the stopping projection 96 which restricts the movement of the supporting member 85. The stopping projection 96 is formed at an end part of the guide frame 95, and restricts the movement of the stopper 87 in one direction. The stopper 87 is formed on the supporting member 85, and is blocked by the stopping projection 96 to prevent the supporting member 85 from moving back to a tension release position when the backup roller 77 moves to a tension applying position by the locking release spring 89. To this end, the stopper 87 is disposed at the end part of the supporting member 85 to be near the locking release spring 89. The stopper 87 has a predetermined elasticity and a tapered outer surface and may be manufactured from various materials, such as plastic, rubber, etc.

Accordingly, if the supporting member 85 moves to the tension applying state from the tension release state, the outer tapered surface of the stopper 87 contacts the stopping projection 96, so that the stopper 87 elastically deforms. Therefore, the supporting member 85 moves to a position where the supporting member 85 can apply the tension to the belt 60 without being interfered with by the stopping projection 96. On the other hand, once the supporting member 85 is positioned to be in the tension applying state, a lower end part of the stopper 87 is configured to face an inner surface of the stopping protrusion 96 and restrict the movement of the supporting member 85. Also, the belt tension applying unit 80 according to an aspect of the present invention includes a pair of stoppers 87 and a corresponding pair of stopping projections 96, as illustrated in FIGS. 3, 5 and 6. However, it is understood that more or less than two stoppers 87 and two stopping protrusions 96 may be used.

Also, according to an aspect of the present invention, the elastic force generated by the locking release spring 89 is adjusted to be greater than the elastic force generated by the elastic member 75 which elastically presses the tension roller 73 so that the belt driving device can easily move from a state shown in FIG. 5 to a state shown in FIG. 6. However, it is understood that the locking release spring 89 is not required to generate more elastic force than the elastic member 75.

Figure 7:
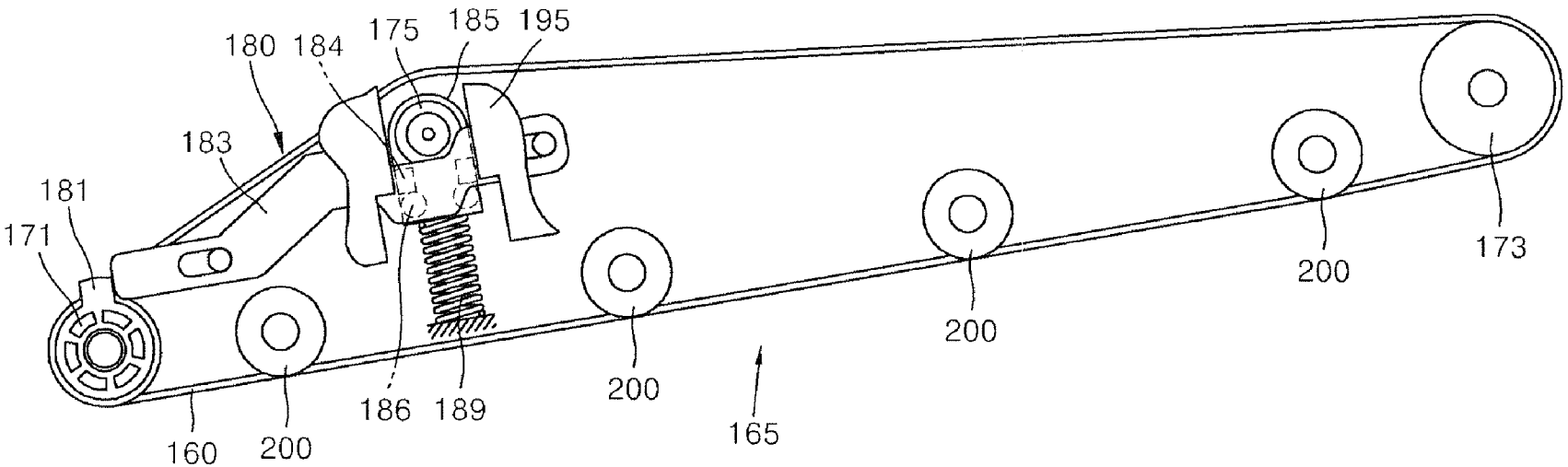
FIG. 7 is a schematic front view of a transfer unit which uses a belt driving device according to another embodiment of the present invention.
Figure 8:
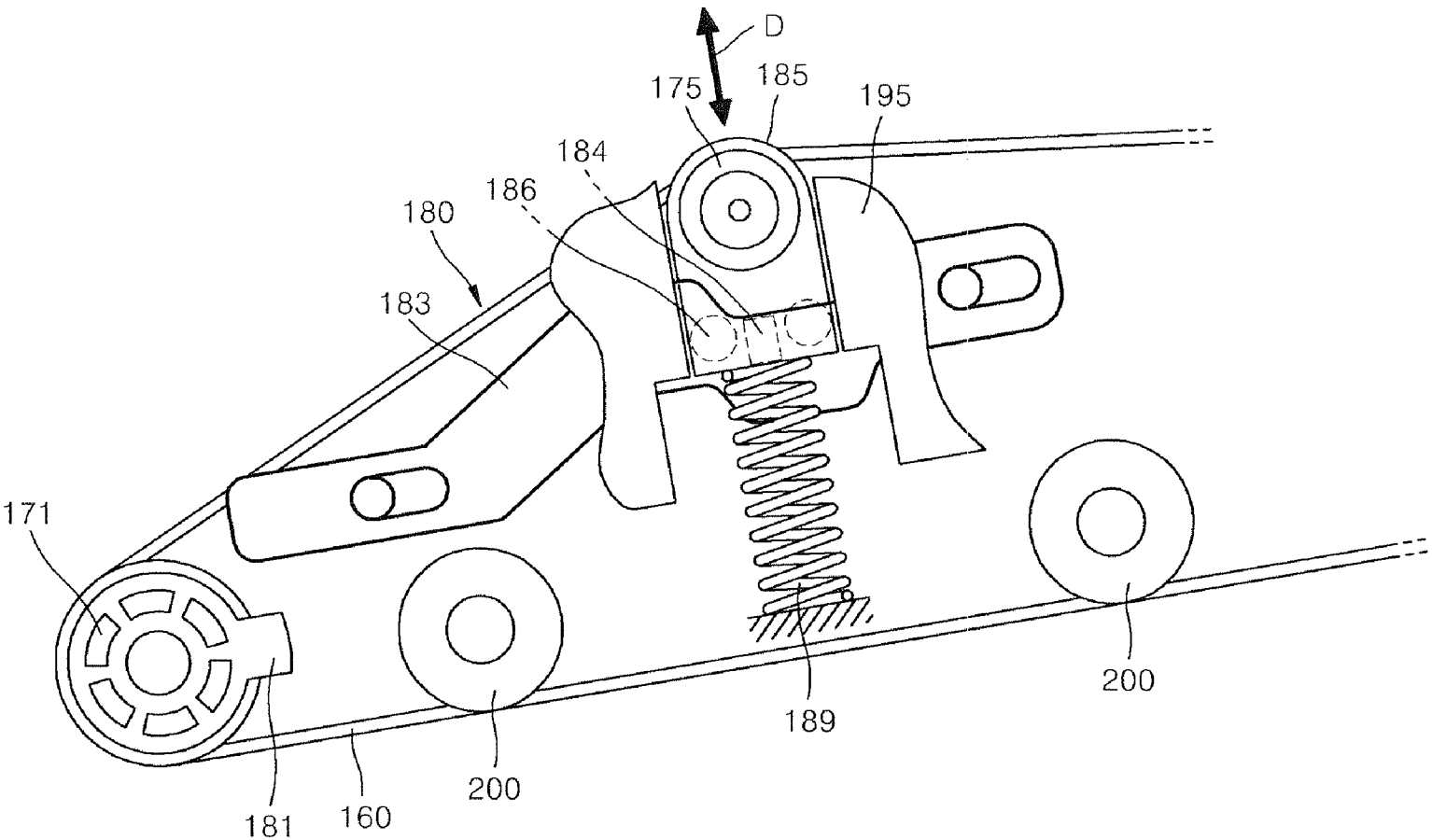
FIG. 8 is a schematic front view of the transfer unit illustrated in FIG. 7 in positions according to an operation state of the belt driving device.

FIG. 7 is a schematic front view of a transfer unit 165 which uses a belt driving device according to another embodiment of the present invention. FIG. 8 is a schematic front view of the transfer unit 165 illustrated in FIG. 7 in positions according to the operation state of the belt driving device.

As shown in FIG. 7 and FIG. 8, the transfer unit 165 which uses the belt driving device according to another embodiment of the present invention includes a belt 160, a belt driving device which is disposed in a main frame (not shown) to drive the belt 160 to rotate, and at least one transfer roller 200 which is disposed at a position where a toner image of a predetermined color is transferred.

The belt driving device includes a plurality of rollers which rotatably support the belt 160, and a belt tension applying unit 180 which applies tension to the belt 160 while the belt 160 is driven and removes the tension applied to the belt 160 in an initial state of non-use. The plurality of rollers includes a driving roller 171 which drives the belt 160 to rotate, a backup roller 173 which supports the belt 160 so that the belt 160 does not interfere with other elements, a tension roller 175 which applies the tension to the belt 160, and a guide frame 195 to guide the tension roller 175 along a direction D.

The driving roller 171 is coupled to a driving source (not shown) either directly, for example, by being connected to a motor, or indirectly via a driving transfer mechanism such as a gear and other driving transfer mechanisms known in the art. Also, at least one photosensitive medium (not shown) is disposed to face a surface of the belt 160 at a position between the driving roller 171 and the backup roller 173. Also, the at least one transfer roller 200 is disposed at an inner surface of the belt 160 to face a corresponding photosensitive medium. Accordingly, the toner image which is formed on the photosensitive medium is attached to the belt 160 by static electricity and transferred to a supplied printing medium (not shown) at the position where the at least one transfer roller 200 is disposed.

Compared to the belt driving device according to the embodiment shown in FIG. 3, the belt driving device according to the embodiment shown in FIG. 7 is different because in the embodiment shown in FIG. 7 the backup roller 173 is rotatably disposed at a fixed position with regard to the main frame, and the elastic member 75 is removed. Also, the belt driving device according to the embodiment shown in FIG. 7 is different because the tension roller 175 in the embodiment shown in FIG. 7 is disposed at the position of the backup roller 77 in the embodiment shown in FIG. 3. Furthermore, the elastic spring 189, which is disposed at the position of the locking release spring 89 in the embodiment shown in FIG. 3, performs not only a locking release function but also functions as the elastic member 75 which maintains the tension of the belt 160 in the embodiment shown in FIG. 7.

The belt tension applying unit 180 releases the belt 160 by biasing the tension roller 175 in a position to remove the tension applied to the belt 160 until the belt 160 is driven for the first time. Then, when the belt 160 is initially driven after installing the transfer unit 165 in the image forming apparatus, the belt tension applying unit 180 moves according to a rotation of the driving roller 171 and restores the tension roller 175 to a tension applying position. Accordingly, when the belt 160 is initially driven, the tension is automatically applied to the belt 160 without requiring a separate operation by the user.

To this end, the belt tension applying unit 180 includes a locking release protrusion 181 which protrudes from the driving roller 171, a locking link 183 which moves by contacting the locking release protrusion 181 at an end part of the locking link 183, a supporting member 185 which rotatably supports the tension roller 175 and is movably installed, and an elastic spring 189. The supporting member 185 rotatably supports the tension roller 175 and is disposed to be movable in a direction in which the tension is applied to the belt 160. In this case, to regulate the movement of the supporting member 185, first and second blocking projections 184 and 186 are formed at a side of the locking link 183 and at a side of the supporting member 185 respectively, where the side of the locking link 183 and the side of the supporting member 185 face each other.

Structures and operations of the locking release protrusion 181, the locking link 183 and the supporting member 185 of the embodiment illustrated in FIG. 7 are substantially the same as the structures and operations of the locking release protrusion 81, the locking link 83 and the supporting member 85 of the embodiment illustrated in FIG. 3, and detailed descriptions thereof are omitted.

Accordingly, as shown in FIG. 7, when the belt driving device is in a period of non-use, such as when the belt driving device is manufactured or a product including the belt driving device, such as an image forming apparatus, is distributed, the second blocking projection 186 is blocked by the first blocking projection 184, so that the elastic force of the elastic member 189 is not transmitted to the supporting member 185. Therefore, the tension applied to the belt 160 is lessened, and the belt 160 maintains a loosened state.

On the other hand, if the transfer unit 165 according to an aspect of the present invention is used in the image forming apparatus and the belt 160 is driven for the first time, for example, when the driving roller 171 is initially supplied with electric power and driven to rotate, the locking state ends. Accordingly, as shown in FIG. 8, the locking link 183 slides the first blocking projection 184 to the side of the second blocking projection 186 so that the second blocking projection 186 is not blocked by the first blocking projection 184. As a result, the elastic force of the elastic member 189 is transmitted to the supporting member 185, and the tension is applied to the belt 160.

Accordingly, the tension roller 175 moves to a position where the tension roller normally performs a driving operation. Then, in performing a printing operation, the tension roller 175 is elastically biased by the elastic member 189, so that the belt 160 maintains a predetermined tension.

Although only belt driving devices which are used in the transfer units 65 and 165 have been described in the embodiments described above, the belt driving device according to aspects of the present invention is not limited to being used in the transfer units 65 and 165 but is also applicable to various belt driving devices which are used in other apparatuses.

Also, in the constitution of the belt driving devices as described above and illustrated in FIGS. 3 and 7, the driving rollers 71 and 171, the tension rollers 73 and 175 and the backup rollers 77 and 173, respectively are described as the embodiments of the plurality of rollers which support the belt. However, the plurality of rollers is not limited to these rollers, and may instead be embodied by many different types of rollers, as long as at least two rollers are included.

Also, in the embodiments described above and illustrated in FIGS. 3 and 7, the locking release protrusions 81 and 181 are formed on the driving rollers 71 and 171 respectively, and the backup rollers 77 and 173 move from the tension release position to the tension applying position. However, the belt tension applying unit according to aspects of the present invention is not limited to being used with the driving rollers 71 and 171 and the backup rollers 77 and 173, but may instead be used with any two rollers selected from the plurality of rollers.

Figure 9:
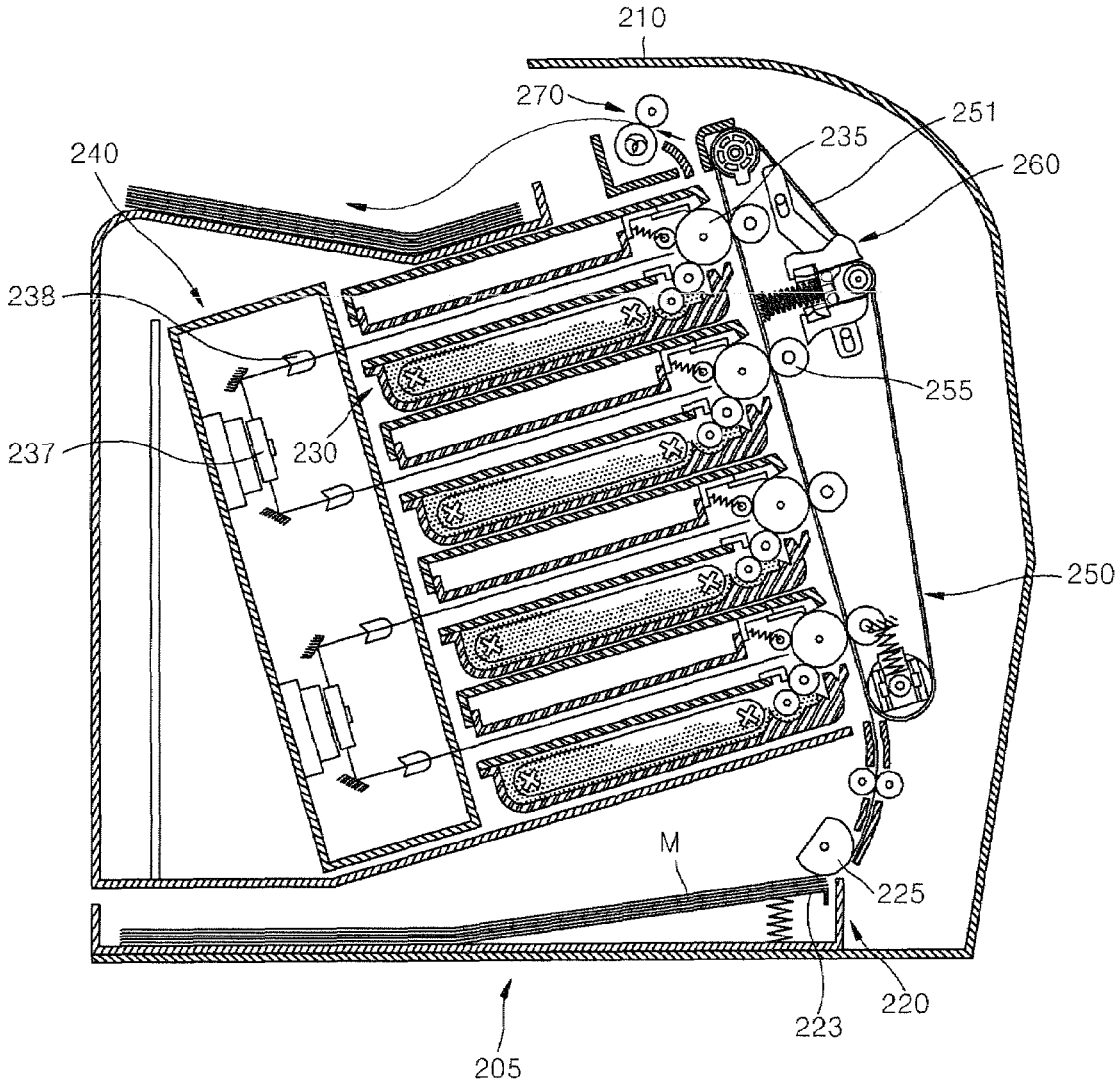
FIG. 9 is a schematic front view of an image forming apparatus according to an embodiment of the present invention.

FIG. 9 is a schematic front view of an image forming apparatus 205 according to an embodiment of the present invention. As shown in FIG. 9, the image forming apparatus 205 according to an aspect of the present invention is a tandem type color image forming apparatus and includes a cabinet 210, a developing unit 230 which is installed in the cabinet 210, a light scanning unit 240, a transfer unit 250 and a fusing unit 270.

The cabinet 210 forms an outer shape of the image forming apparatus 205. A supplying unit 220 where printing media M are loaded is detachably disposed in the cabinet 210. The printing media M may be sheets of paper, transparency sheets, etc. The printing media M are supplied from the supplying unit 220 and conveyed through a conveying path to a space between the developing unit 230 and the transfer unit 250. The supplying unit 220 is disposed inside the cabinet 210 and includes a knock-up plate 223 where the printing media M are loaded and a feeding roller 225 which picks up individual sheets of the printing media M loaded on the knock-up plate 223.

The developing unit 230 includes a photosensitive medium 235 which reacts to a light beam transmitted by the light scanning unit 240 to form an electrostatic latent image. The developing unit 230 develops a toner image on the photosensitive medium 235 to form a toner image on the photosensitive medium 235. According to an aspect of the present invention, the image forming apparatus includes a plurality of the developing units 230 and each developing unit 230 corresponds to a color so that the plurality of developing units 230 can form a full color image by using a single pass method. The developing units 230 shown in FIG. 9 illustrate an embodiment which includes four developing units 230 to realize each color of yellow Y, magenta M, cyan C and black K.

The light scanning unit 240 scans the light beam to form the electrostatic latent image on each of a plurality of photosensitive media 235 corresponding to the plurality of developing units 230. To this end, the light scanning unit 240 has a multi-beam light scanning structure to scan the light beam onto the plurality of photosensitive media 235 simultaneously, and includes a plurality of light sources (not shown), a plurality of beam deflectors 237 which deflect the light beams irradiated by the light sources to the photosensitive media 235, and a plurality of focusing lens 238 which focus the light beams deflected by the beam deflectors onto scanning surfaces of the photosensitive media 235. According to an aspect of the present invention, each of the light sources includes a light source having a plurality of light emitting points. Alternatively, each of the light sources may include a plurality of semiconductor devices, each of which has a single light emitting point to correspond to each color.

The transfer unit 250 is disposed opposite to the plurality of photosensitive media 235 to convey a sheet of the printing media M through the conveying path therebetween, and transfers the toner image formed on the plurality of photosensitive media 235 onto the supplied sheet of the printing media M. To this end, the transfer unit 250 includes a transfer belt 251 and a plurality of transfer rollers 255 which are disposed opposite to the corresponding plurality of photosensitive media 235, and a belt driving device which drives the transfer belt 251 to rotate. The belt driving device includes a plurality of rollers which rotatably support the transfer belt 251, and a belt tension applying unit 260 which not only applies tension to the transfer belt 251 when the transfer belt 251 is normally driven but also removes the tension applied to the transfer belt 251 in an initial state before the transfer belt 251 is driven.

In this case, the structures and operations of the transfer unit 250 and the belt tension applying unit 260 are substantially the same as those of the transfer units and the belt driving devices in the first and second embodiments described above and respectively illustrated in FIGS. 3 and 7, and detailed descriptions thereof are omitted.

The image transferred onto the sheet of the printing media P by the transfer unit 250 described above is fused by the fusing unit 270.

As described above, the belt driving device according to aspects of the present invention maintains a loosened state of the belt 60 by releasing the tension applied to the belt 60 until the belt 60 is used for the first time. Also, since the belt driving device according to aspects of the present invention includes the belt tension applying unit 80 which is driven in connection with the belt 60, the belt driving device automatically applies the tension to the belt 60 to remove the belt 60 from the loosened state without a separate operation by a user. Therefore, the belt driving device according to aspects of the present invention prevents malfunctions and other problems from occurring due to a user failing to remove the release spacer 50, which has been a problem in the conventional method where the belt tension is applied only after the user performs a manual operation.

Also, when the belt 60 is driven for the first time, the transfer unit 65 and the image forming apparatus 205 according to aspects of the present invention automatically applies tension to the belt 60 by adopting the belt driving device described above. Therefore, aspects of the present invention prevent the belt 60 from being used in the state where the tension is not applied to the belt 60.

Although a few embodiments of the present invention have been shown and described, it would be appreciated by those skilled in the art that changes may be made in this embodiment without departing from the principles and spirit of the invention, the scope of which is defined in the appended claims and their equivalents.

What is claimed is:

1. An image forming apparatus comprising:

a developing unit that develops toner to form an image;

a transfer unit that transfers the image onto a printing medium; and a fusing unit that fuses the transferred image onto the printing medium, wherein the transfer unit comprises:

a belt;

a first roller that selectively contacts the belt;

a second roller that drives the belt;

a locking link that is moved according to a rotation of the second roller;

a supporting member to moveably support the first roller; and a guide frame to house the supporting member and to guide the movement of the supporting member according to the movement of the locking link, between a belt tension releasing position, where the first roller does not contact the belt, and a belt tension applying position, where the first roller is biased against the belt.

2. The image forming apparatus according to claim 1, wherein when the first roller is positioned at the belt tension applying position, the second roller does not contact the locking link, as the belt is driven.

3. The image forming apparatus according to claim 1, wherein the second roller comprises a locking release protrusion that protrudes orthogonally to an axis of rotation of the second roller, which selectively contacts the locking link, to move the locking link.

4. The image forming apparatus according to claim 3, wherein when the first roller is positioned at the belt tension applying position, the locking release protrusion does not contact the locking link.

5. The image forming apparatus according to claim 1, wherein:

the locking link has a first blocking projection;

the supporting member has a second blocking projection, that is selectively blocked by contact with the first blocking projection; and when the locking link is moved, the first blocking projection moves out of contact with the second blocking projection, and the supporting member moves to the belt tension releasing position.

6. The image forming apparatus according to claim 1, further comprising a locking release spring that elastically biases the supporting member toward the belt tension applying position.

7. The image forming apparatus according to claim 1, further comprising:

a stopping projection formed on the guide frame; and a stopper formed on the supporting member, wherein the stopping projection interlocks with the stopper, to lock the supporting member in the belt tension applying position.

8. The image forming apparatus according to claim 7, wherein the stopper comprises an elastic material and a tapered surface that gradually widens in a direction extending away from the first roller.

9. The image forming apparatus according to claim 1, further comprising:

a pair of stoppers disposed on opposite sides of the supporting member; and a pair of stopping projections disposed on opposite sides of the guide frame, wherein the stopping projections interlock with the stoppers, to lock the supporting member in the belt tension applying position.

10. The image forming apparatus according to claim 6, wherein the transfer unit further comprises:

a third roller to apply tension to the belt; and an elastic member that elastically biases the third roller against the belt.

11. The image forming apparatus according to claim 10, wherein an elastic force generated by the locking release spring is greater than an elastic force generated by the elastic member.

12. The image forming apparatus according to claim 10, wherein:

the first roller comprises a backup roller that rotatably supports the belt;

the second roller comprises a driving roller that rotates the belt;

the third roller comprises a tension roller;

the locking release protrusion is formed on the driving roller; and the supporting member rotatably supports the backup roller.

13. An image forming apparatus, comprising:

a developing unit that develops toner to form an image;

a transfer unit that transfers the image onto a printing medium; and a fusing unit that fuses the transferred image onto the printing medium, wherein the transfer unit comprises:

a belt;

a driving roller that rotates the belt;

a tension roller that selectively applies a tension to the belt;

a locking release protrusion that protrudes from the driving roller;

a locking link having a first blocking projection;

a supporting member to moveably support the tension roller, having a second blocking projection that is selectively blocked by contact with the first blocking projection; and a guide frame to house the supporting member and to guide the movement of the supporting member, according to the movement of the locking link, between a belt tension releasing position, where the tension roller is not biased against the belt, and a belt tension applying position, where the tension roller is biased against the belt, wherein when the driving roller is rotated, the locking release protrusion moves the locking link, such that the second blocking projection does not contact the first blocking projection, and the supporting member moves the tension roller into the belt tension applying position.

14. The image forming apparatus according to claim 13, wherein the transfer unit further comprises an elastic member that elastically biases the supporting member toward the belt tension applying position, such that the tension roller applies the tension to the belt.

15. An image forming apparatus, comprising:

a developing unit that develops toner to form an image;

a transfer unit that transfers the image onto a printing medium; and a fusing unit that fuses the transferred image transferred onto the printing medium, wherein the transfer unit comprises:

a belt;

a first roller to drive the belt, having a locking release protrusion extending from a side thereof;

a second roller to apply tension to the belt; and a locking release member to bias the second roller towards the belt;

a locking link that is moved by the locking release protrusion, when the driving roller rotates, the locking link having a first blocking projection;

a supporting member to support the second roller, having a second blocking projection that is selectively blocked by contact with the first blocking projection;

a guide frame to house the supporting member and to guide the supporting member between a belt tension releasing position, where the second roller does not apply tension to the belt, and a belt tension applying position, where the second roller applies tension the belt;

a stopper formed on the supporting member; and a stopping projection formed on the guide frame, wherein the stopping projection interlocks with the stopper, to lock the supporting member at the belt tension applying position, when the second blocking projection is not blocked by the first blocking projection.

16. The image forming apparatus according to claim 15, when the second roller is positioned at the belt tension applying position, the locking release protrusion does not contact the locking link, as the belt is driven.

17. The image forming apparatus according to claim 15, further comprising:

a third roller; and an elastic member to elastically bias the third roller towards the belt, to apply additional tension to the belt.

18. A method of driving a belt, comprising:

rotating a first roller having a locking release protrusion extending from a side thereof, to rotate the belt;

using the locking release protrusion to move a locking link having a first blocking projection, from a position where the first blocking projection blocks a second blocking projection of a locking release member, to keep the belt in a loosened state, to a position that does not blocks the second blocking projection, so that the locking release member biases a second roller towards the belt, to apply the tension to the belt.

19. The method according to claim 18, further comprising moving a supporting member connected to the locking release member, in a direction in which the second roller applies the tension to the belt, by unblocking the locking release member, wherein the supporting member rotatably supports the second roller and is connected to the locking release member.

20. The method according to claim 19, further comprising using a guide frame to guide the supporting member toward the belt, such that the second roller applies the tension to the belt.

21. The method according to claim 20, further comprising preventing the supporting member from moving away from the belt, by blocking a stopper formed at one end of the supporting member with a stopping projection of the guide frame, after the supporting member moves a predetermined distance toward the belt.

22. A transfer unit, comprising:

a transfer belt to transfer a printing medium;

a tension roller to apply tension to the belt;

a backup roller to selectively apply tension to the belt;

a driving roller to drive the belt;

a locking release protrusion that protrudes from the driving roller;

a locking link that is moved by the locking release protrusion when the driving roller is driven, the locking link having a first blocking projection;

a supporting member to moveably support the backup roller, having a second blocking projection that is blocked when in contact with the first blocking projection; and a guide frame to house the supporting member and to guide the movement of the supporting member, between a belt tension releasing position, where the backup roller does not apply tension to the belt, and a belt tension applying position, where the backup roller applies tension to the belt, wherein when the driving roller is rotated, the locking release protrusion moves the locking link, such that the second blocking projection does not contact the first blocking projection, and the supporting member moves the backup roller into the belt tension applying position.

23. The transfer unit according to claim 22, further comprising a locking release spring that elastically biases the supporting member toward the belt.

* * * * *

UNITED STATES PATENT AND TRADEMARK OFFICE

CERTIFICATE OF CORRECTION

PATENT NO. : 7,657,207 B2
APPLICATION NO. : 11/832341
DATED : February 2, 2010
INVENTOR(S) : Il-kwon Kang It is certified that error appears in the above-identified patent and that said Letters Patent is hereby corrected as shown below:

Column 1, Line 9, change "2006-117052," to --10-2006-117052,--.

Column 13, Line 58, after "tension" insert --to--.

Signed and Sealed this

Fifteenth Day of June, 2010

David J. Kappos

David J. Kappos
*Director of the United States Patent and Trademark Office*